US005191306A

United States Patent [19]

Kaji et al.

[11] Patent Number: 5,191,306

[45] Date of Patent: Mar. 2, 1993

[54] MINIATURE ELECTROMAGNETIC ASSEMBLY AND RELAY WITH THE MINIATURE ELECTROMAGNET ASSEMBLY

[75] Inventors: Norimasa Kaji, Ibaragi; Mitsuo Ichiya, Hirakata; Hiromi Nishimura, Takatsuki; Kazuhiko Inoue, Kadoma; Hideki Fukuzono, Nara; Yutaka Yamada, Shijonawate, all of Japan

[73] Assignee: Matsushita Electric Works, Ltd., Osaka, Japan

[21] Appl. No.: 808,770

[22] Filed: Dec. 17, 1991

[30] Foreign Application Priority Data

Sep. 14, 1990 [JP] Japan ..... 2-96726
Dec. 28, 1990 [JP] Japan ..... 2-409255
Apr. 24, 1991 [JP] Japan ..... 3-93824

[51] Int. Cl.[5] ..... H01H 51/22

[52] U.S. Cl. ..... 335/78; 335/80; 335/128

[58] Field of Search ..... 335/78–86, 335/124, 128, 131, 133

[56] References Cited

U.S. PATENT DOCUMENTS 4,272,745 6/1981 Tanaka et al. ..... 335/128
4,684,909 8/1987 Dittmann ..... 335/128
4,975,666 12/1990 Nobutoki ..... 335/78

FOREIGN PATENT DOCUMENTS 63-143841 9/1988 Japan .
63-143842 9/1988 Japan .
63-165809 10/1988 Japan .
1-16044 1/1989 Japan .
1-142132 8/1989 Japan .
1-164643 11/1989 Japan .
1-168941 11/1989 Japan .
1-302631 12/1989 Japan .
2-12721 1/1990 Japan .

*Primary Examiner*—Lincoln Donovan
*Attorney, Agent, or Firm*—Stevens, Davis, Miller & Mosher

[57] ABSTRACT

A miniaturized electromagnet has an enhanced armature attraction force and reliable armature movement. The electromagnet comprises an L-shaped flat magnetic plate of magnetic material with a horizontally extending core and a first yoke leg depending from one end of the core. An excitation coil is wound around the core. A second yoke member is formed separately from the magnetic plate into a plate configuration and is coupled secured at its upper end to the other end of the core so as to depend therefrom in an opposed relation to the first yoke leg. The lower end portion of the second yoke leg is bent toward the first yoke leg to define thereat a pole plate extending parallel with the core. An armature extends in a parallel relation to the core and is magnetically coupled at its one end to the first yoke leg and is pivotally supported adjacent thereto such that the armature is pivotable within a horizontal plane between set and reset positions of having the pole end attracted to and spaced away from the second yoke leg in response to the energization and deenergization of the excitation coil, respectively. With the provision of the pole plate extending toward the first yoke leg, the armature can be made to have a correspondingly reduced effective length and equivalent mass, whereby the armature can have an increased magnetically attraction force for reliable electromagnetic operation.

6 Claims, 7 Drawing Sheets

MINIATURE ELECTROMAGNETIC ASSEMBLY AND RELAY WITH THE MINIATURE ELECTROMAGNET ASSEMBLY

BACKGROUND OF THE INVENTION

1. Field of the Invention

The present invention is directed to a miniature electromagnet and relay, and more particularly to an electromagnet assembly for the relay with reduced length and thickness.

2. Description of the Prior Art

Japanese Utility Model early publication [Kokai] No. 1-168941 proposes a miniature electromagnetic relay which is particularly designed to accomplish a compact structure of reduced thickness by the use of an U-shaped flat magnetic plate having opposed yoke legs in combination with an armature extending between the opposed yoke legs. As shown in FIG. 1, the prior art relay includes an electromagnet unit comprising the U-shaped flat magnetic plate 11A of a magnetic material having a core 12A and a pair of first and second yoke legs 13A and 14A depending from the opposite ends of the core 12A. A coil bobbin 20A is fitted around the core 12A to carry an excitation coil 30A. The armature 40A, which is also of U-shaped configuration with a pivot end 41A and a pole end 44A, bridges between the first and second yoke legs 13A and 14A in parallel with the core 12A. The pivot end 41A is kept in constant magnetic coupling with the first yoke leg 13A and is at the same time pivotally supported adjacent to the first yoke leg 13A such that the armature 40A can pivot about the pivot end 41A within a horizontal plane parallel to the core 12A between a set position where the pole end 44A is attracted to the second yoke leg 14A in response to the energization of the excitation coil 30A and a reset position where the pole end 44A is spaced away from the second yoke leg 14A in response to the deenergization of the excitation coil 30A. The armature 40A carries a cam 46A for actuating a movable contact for contact closing and opening. This structure permits disposing the armature 40A together with the first and second yoke legs 13A and 14A within a coil thickness of the coil bobbin 20A and permits the armature 40A to pivot within the coil thickness, whereby successfully reducing the, overall thickness of the electromagnet structure to as little as the coil thickness. However, the second yoke leg 14A itself adds an extra lengthwise dimension L1 to the length of an overall length L0 of the electromagnet, thereby increasing the length of the armature 40A. Further, the armature 40A is required to have an enlarged surface area at the pole end 44A in such a manner as to overlap the second yoke leg 14A to an increased extent, i.e, to have a magnetic gap of increased opposing surface area between the pole end 44A and the second yoke leg 14A for generating a correspondingly strong attraction force at the magnetic gap. Consequently, the armature 40A has to be made to have an increased equivalent weight because of the elongated effective length from the pivot end 41A to the pole end 44A and also because of the enlarged pole end 44A, thereby suffering from a correspondingly lowered armature attraction force at the magnetic gap which might frequently result in unstable and unreliable armature operation. Also, since the second yoke leg 14A in the form of the plate adds an extra dimension L1 to the overall length L0 of the electromagnet, there is a certain limitation as to the length Lc of the excitation coil 20A within the overall length L0 of the electromagnet, thereby limiting a number of coil turns and therefore limiting the electromagnet force obtained in the electromagnet structure of the limited overall length L0, which is also the hindrance to increasing a armature attraction force within the electromagnet structure of the limited lengthwise dimension.

SUMMARY OF THE INVENTION

The above problem has been eliminated in the present invention which adopts a unique core and yoke configuration to obtain a strong armature attraction force within a limited dimensional requirement imposed on an electromagnet. An electromagnet in accordance with the present invention comprises an L-shaped flat magnetic plate of magnetic material with a horizontally extending core and a first yoke leg integrally depending from one end of the core and a coil assembly with an excitation coil disposed around the core. The coil assembly defines a coil thickness extending horizontally in a direction perpendicular to the length of the core. A second yoke leg made of magnetic material depends from the other end of the core in a parallel relation to the first yoke leg. An armature extends between the first and second yoke legs in parallel with the core to complete a loop of magnetic flux to be generated by the energization of the excitation coil. The armature has a pivot end and a pole end at its opposite ends and is pivotally supported at the pivot end adjacent to the first yoke leg in constant magnetic coupling to the first yoke leg such that the armature is pivotable about the pivot end in a horizontal plane parallel to a plane of the core within the coil thickness between a set position and a reset position so that the pole end is attracted to and spaced away from the second yoke leg upon energization and deenergization of the excitation coil, respectively. The characterizing feature of the electromagnet resides in that the second yoke leg is of a flat plate configuration having a general plane extending perpendicular to that of the flat magnetic plate and that the second yoke leg has its lower end portion bent at substantially a right angle toward the first yoke leg to define thereat a pole plate which is disposed in a plane parallel to that of the flat magnetic plate in an overlapping relation to the pole end of the armature for attracting the pole end upon energization of the excitation coil. With this unique configuration of the second yoke leg having the pole plate bent toward the first yoke leg, a distance to be covered by the length of the armature can be reduced while providing a sufficiently large opposing surface area at the pole plate for attraction of the pole end of the armature, yet adding to the overall length of the electromagnet only by a thickness of the second yoke leg. Therefore, it is possible to reduce an equivalent mass of the pivotally supported armature with the reduced length requirement and increased opposing surface area between the pole end and the pole plate, thereby obtaining a maximum armature attraction force within a limited lengthwise dimension of the electromagnet, in addition to that the excitation coil can be wound over an extended length within the overall length of the electromagnet to have an increased number of turns.

Accordingly, it is a primary object of the present invention to provide an improved miniature electromagnet which is capable of obtaining a maximum armature attraction force and therefore a reliable armature operation within a limited dimensional requirement.

Preferably, the second yoke leg is made separately from the flat magnetic plate and is rigidly secured to the flat magnetic plate such as by a laser beam welding. To this end, the second yoke leg is formed to have a cavity into which the associated end of the core is fitted for facilitating the welding. With this welding, the flat magnetic plate and the second yoke leg can be secured without relying upon other external mechanical forces which might otherwise cause distortion or misalignment between the magnetic plate and the second yoke leg. Therefore, the pole plate of the second yoke leg can be assembled accurately into a predetermined spacial relationship with the first yoke leg or the armature, thereby ensuring a reliable armature movement. Further, it is possible with the welding to eliminate the possibility of increasing magnetic resistance at the connection between the magnetic plate and the second yoke leg which would be otherwise occur when they are assembled mechanically.

It is therefore another object of the present invention to provide an improved miniature electromagnet in which the magnetic plate and the second yoke leg can be assembled accurately into a predetermined position for enhanced reliability of the armature operation.

The electromagnet further includes a support member disposed in an adjacent relation to the first yoke leg. The support member is formed with a pair of vertically spaced bearing holes into which a corresponding pair of projections on the pivot end of the armature are seated, respectively, in such a manner as to pivotally support the armature while keeping the pivot end of the armature in constant direct contact with the first yoke leg. Thus, the armature can be stably supported for smooth and reliable movement between the set and reset positions while being kept in constant direct contact with the first yoke leg, which is therefore a further object of the present invention.

In a preferred embodiment, the pole plate is bent at a right angle with respect to the general plane of the second yoke leg by cold-forging in such a manner as to leave no substantial notch between the pole plate and the remaining portion of the second yoke leg, which notch would otherwise act to decrease the cross sectional area between the pole plate and the remaining portion of the second yoke leg. By using the cold-forging technique, the pole plate can be successfully bent without necessitating the notch at the intersection between the pole plate and the remaining portion of the second yoke leg so that the second yoke leg can be free from undesirable reduction in the cross sectional area for the magnetic flux path, i.e., magnetic efficiency.

It is therefore a still further object of the present invention to provide an improved miniature electromagnet in which the pole plate can be successfully bent without accompanying undesirable lowering of the magnetic efficiency.

In a preferred embodiment, the electromagnet is utilized to constitute a miniature electromagnetic relay provided with a fixed contact and a movable contact. The movable contact is operatively connected to the armature to be movable together therewith between a closed condition of engaging the fixed contact and an open condition of disengaging from the fixed contact. The fixed and movable contacts are disposed within the coil thickness and within the length of the flat magnetic plate in vertically spaced relation to the excitation coil. Thus, the relay can be assembled into a like compact structure without addition extra dimension to the length and thickness of the electromagnet, while retaining the reliable armature operation.

These and still other objects and advantageous features of a present invention will become more apparent from the following description the preferred embodiment of the present invention when taken in conjunction with the attached drawings.

DESCRIPTION OF THE PREFERRED EMBODIMENT

Figure 1:
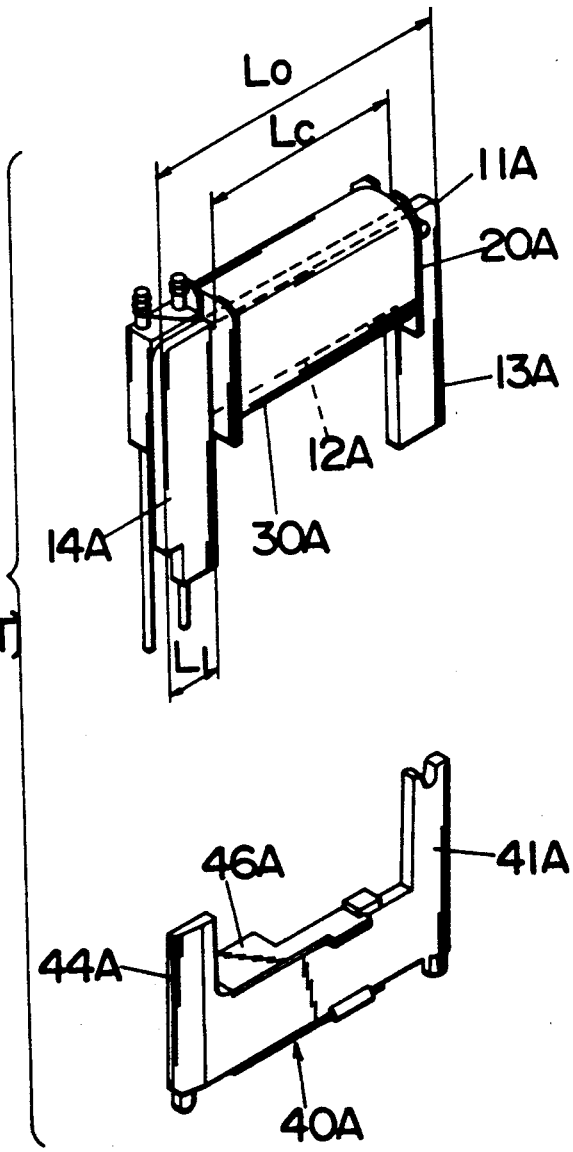
Fig. 1 (PRIOR ART)
FIG. 1 is an exploded perspective view of a prior art miniature relay.

Referring now to FIGS. 2 to 7, a miniature electromagnetic relay in accordance with a preferred embodiment of the present invention comprises an electromagnet unit 10 and a contact unit 50 mounted on a base 60 made of an electrically insulating plastic material. The contact unit 50 includes a fixed contact member 51 carrying a fixed contact 52 and a movable spring leaf 53 carrying a movable contact 54. A pair of terminal legs 55 and 56 extending downwardly through the base 60 from the fixed contact member 51 and the movable spring leaf 53, respectively. The electromagnet unit 10 includes an excitation coil 30 and is assembled on the base 60 with the excitation coil 30 located in a vertically spaced relation to the contacts 52 and 54 and with an insulator 71 interposed for electrical insulation between the excitation coil 21 and the contact unit 50. A cover 70 of electrically insulating material fitted over the base 60 to seal therein the electromagnet unit 50 and the contact unit 50.

Figure 2:
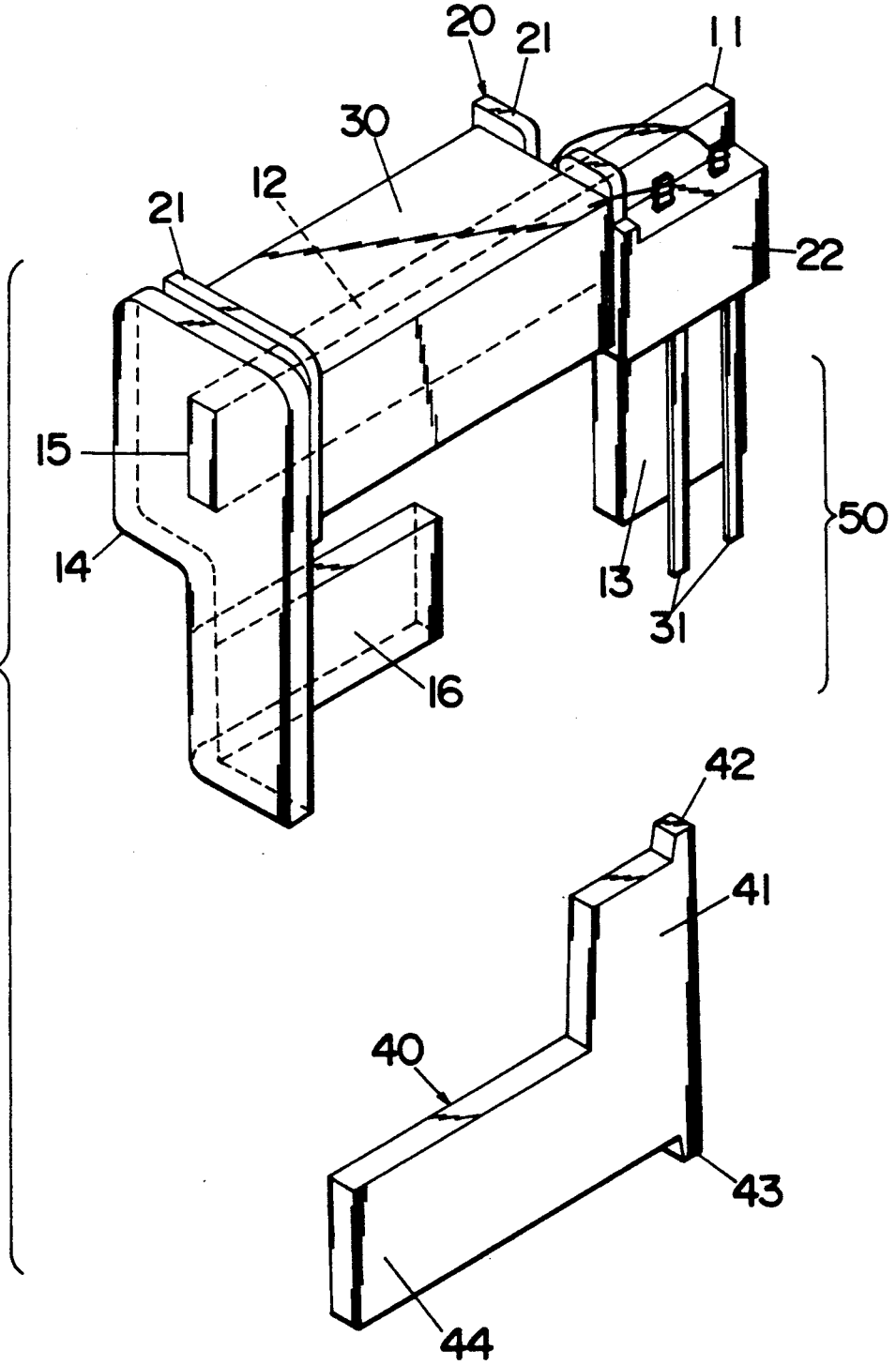
FIG. 2 is an exploded perspective view, rather in schematic representation, of an electromagnet assembly utilized in a miniature electromagnetic relay in accordance with a preferred embodiment of the present invention.
Figure 3:
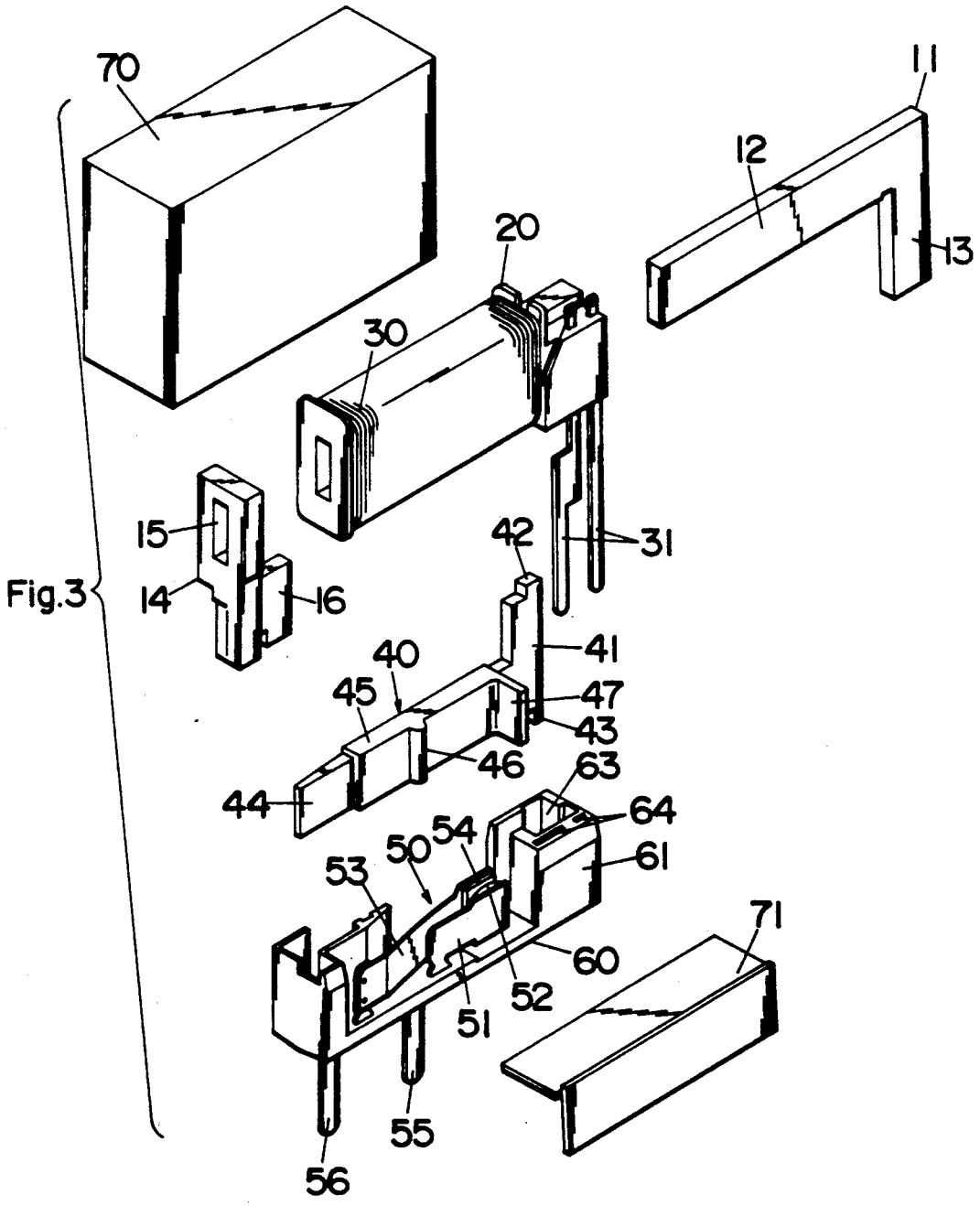
FIG. 3 is a further exploded perspective view of the relay.
Figure 4:
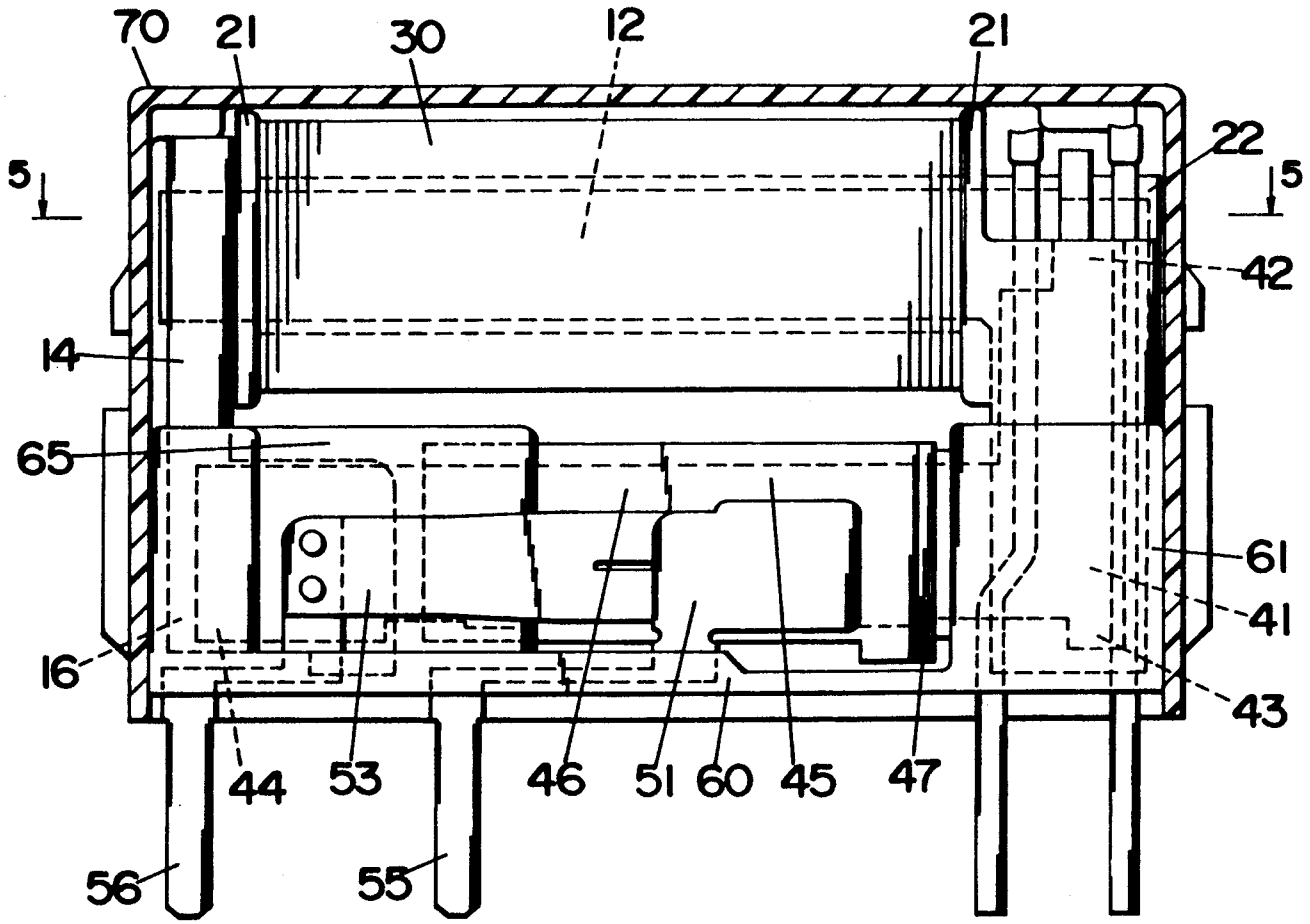
FIG. 4 is a front view partly in section of the relay.

As shown in FIGS. 2 and 3, the electromagnet unit 10 comprises an L-shaped flat magnetic plate 11 of a magnetic material with a horizontally extending core 12 and a first yoke leg 13 integrally depending from one end of the core 12 within a common vertical plane. A coil bobbin 20 is fitted around the core 12 to carry the excitation coil 30 between opposed flanges 21 of the bobbin 20 over substantially the entire length of the core 12. The excitation coil 21 is wound about the bobbin 20 to have a coil thickness which extends laterally within a horizontal plane including the core 21 and is substantially equal to the width of the bobbin flanges 21.

The coil bobbin 20 is additionally formed with an integrally-molded holder 22 extending past the flange 21 to overlap the upper end portion of the first yoke leg 13 for supporting a pair of coil terminals 31 in such a manner that the coil terminals 31 extends in parallel with the first yoke leg 13 within the coil thickness to have their respective lower ends penetrating through the base 60. The upper end portions of the coil terminals 31 are molded in into the holder 22 to have the respective distal upper ends for wiring connection to the ends of the excitation coil 30.

Figure 5:
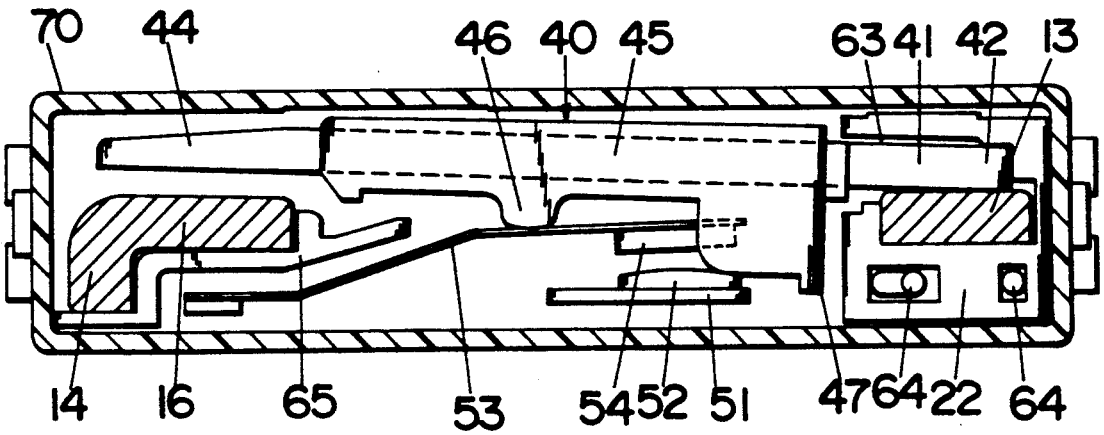
FIG. 5 is a cross-section taken along line 5—5 of FIG. 4.
Figure 6:
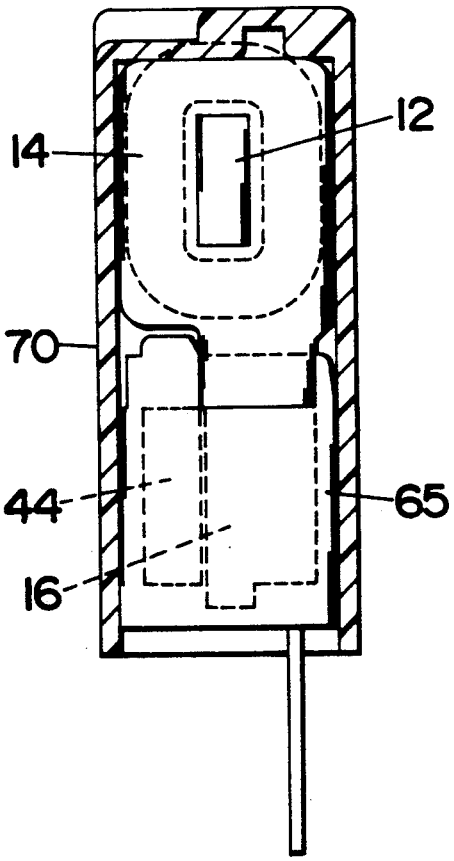
FIG. 6 is a right-hand side view partly in section of the relay.
Figure 7:
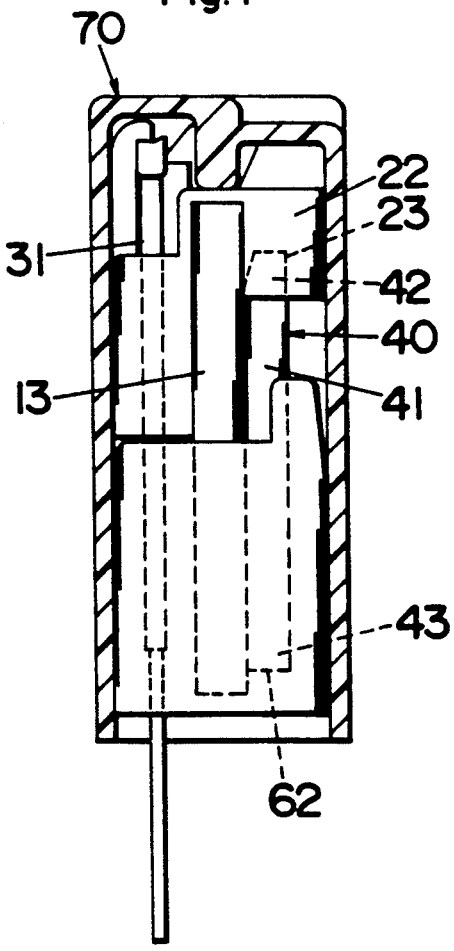
FIG. 7 is a left-hand side view partly in section of the relay.
Figure 8:
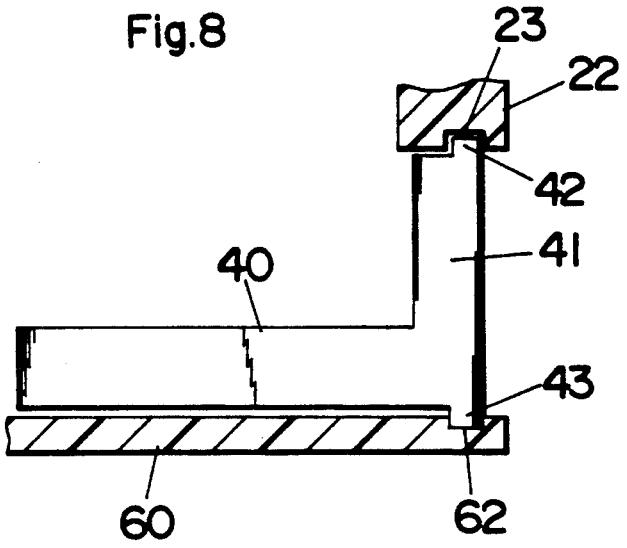
FIG. 8 is a schematic view illustrating a supporting structure for an armature of the relay.

A second yoke leg 14 of a magnetic material is formed seperately from the flat magnetic plate 11 in the form of a flat plate and is physically and magnetically coupled to the other end of the core 12 to depend therefrom in an opposed relation to the first yoke leg 13. The second yoke leg 14 is formed in its upper portion with a cavity 15 for receiving the other end of the core 12. The core 12 is rigidly secured to the second yoke leg 14 by means of the YAG laser welding to the engagement of the core 12 into the cavity 15. With the use of laser welding technique, no substantial external force is applied to the connection such that the second yoke leg 14 can be secured to the flat magnetic plate 11 to have an accurate spacial relationship therewith as intended. The upper end of the second yoke leg 14 is dimensioned to have a width substantially equal to the coil thickness so as not to add an extra dimension to the thickness of the electromagnet unit 10. The lower portion of the second yoke leg 14 is bent at a right angle toward the first yoke leg 13 to define thereat a pole plate 16 extending parallel to the core 12 within a common vertical plane including the core 12 and the first yoke leg 13 in a direction of decreasing a distance between the first yoke leg 13 and the second yoke leg 14. An armature 40 extends between the first yoke leg 13 and the pole plate 16 to establish a magnetic circuit of the electromagnet with its one end in constant direct contact with the first yoke leg 13 and the other end define an air gap with the pole plate 16. The armature 40 is provided in the form of L-shaped configuration to have a vertically extending pivot end 41 with upper and lower projections 42 and 43. The free end of a horizontal segment of the armature 40 defines a pole end 44 which is engageable with the pole plate 16 in an overlapping relation thereto to have a gap forming surface area corresponding to that of the pole plate 16. A sleeve 45 of electrically insulating material is fitted over the portion of the horizontal segment of the armature 40 so as to only expose the pole end 44 and the pivot end 41. The armature 40 is pivotally supported at its pivot end to be pivotable within a horizontal plane between a set position where the pole end 44 is attracted to the pole plate 16 in response to the energization of the excitation coil 30 and a reset position where the pole end 44 is spaced away from the pole plate 16 in response to the deenergization of the excitation coil 30. To this end, the projections 42 and 43 of the pivot end 41 are respectively held within bearing holes 23 and 62 (see FIG. 7) respectively formed in the holder 22 and a post 61 integrally upstanding from one longitudinal end of the base 60, as schematically shown in FIG. 8. The bearing hole 23 is formed in a portion of the holder 22 on the opposite side of the first yoke leg 13 from the portion through Which the coil terminals 31 extend, while the bearing hole 62 is formed in the bottom of the post 61, as shown in FIG. 7. The post 61 is formed to have a slot 63 for receiving the lower end portion of the first yoke leg 13 together with the corresponding portion of the pivot end 41 of the armature 40 and to have a pair of vertical slits 64 through which the coil terminals 31 extend, respectively. As seen in FIGS. 5 and 7, the pivot end 41 of the armature 40 is kept in edge contact with the first yoke leg 13 so as to establish constant magnetic coupling therebetween during the pivotal movement of the armature 40 between the set and reset positions.

The armature 40 thus supported between the base 60 and the electromagnet unit 10 is operatively connected to the spring leaf 53 by engagement of a cam projection 46 on the sleeve 46 with the spring leaf 53 in such a manner that the armature 40 is spring-biased by the spring leaf 53 toward its reset position of FIG. 5 and moves the spring leaf 53 against the spring bias to engage the movable contact 54 to the fixed contact 52 when attracted to the pole plate 16 in response to the energization of the excitation coil 30. The armature 40 is disposed on the base 60 in a laterally offset relation from the contact members 51 to 54 and is electrically insulated therefrom by a combination of an integral partition 65 on the base 60, the sleeve 41, and a sleeve flange 47 formed at the end of the sleeve 41 to conceal the slot 63 therebehind. It is noted here that the armature 40 and the contact members 50 to 54 are all disposed within the coil thickness such that the relay can be assembled to have a reduced thickness which may be as small as the coil thickness.

Figure 9B:
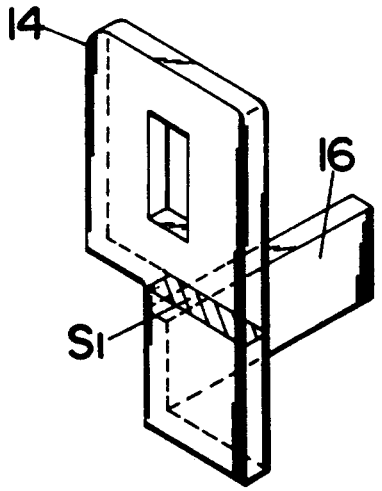
FIGS. 9A and 9B are perspective views of a second yoke leg of the relay with a pole plate bent at a right angle with and without leaving a notch at the intersection between the pole plate and the remaining portion of the yoke leg, respectively.
Figure 9A:
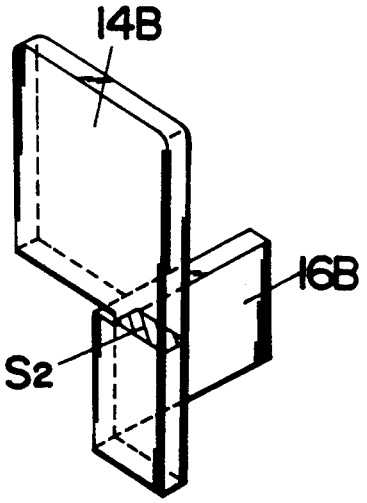

A cold-forging technique is utilized to bend the pole plate 16 toward the first yoke leg 13 in such a manner as to leave no substantial notch at the intersection between the pole plate 16 and the remaining portion of the second yoke leg 14, as best shown in FIG. 9B, in order to avoid undue reduction in cross-sectional area at the intersection leading to undesirably lowered magnetic efficiency of the electromagnet. Such notch is normally required when bending to form a like pole plate 16B from a like second yoke leg 14B, as shown in FIG. 9A, and certainly suffers from a reduced Cross-sectional area S2 at the intersection therebetween, which is apparently lower than that S1 in FIG. 9B of the present embodiment and accordingly lower magnetic efficiency of the electromagnet.

Figure 10:
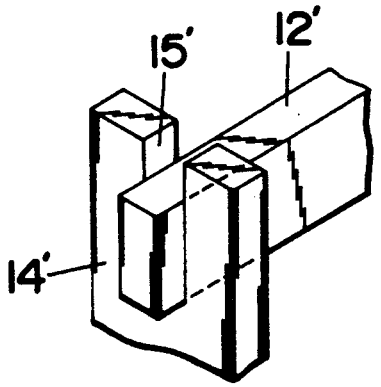
FIG. 10 is a partial view illustrating a different coupling structure which may be utilized for coupling the core and the second yoke leg by welding.

FIG. 10 shows a modification of the above embodiment in which a like core 12' has its one end fitted into a recess 15' at the upper end of a like second yoke leg 14' prior to the welding connection therebetween by the YAG laser welding or the like laser welding technique. Also in this alternative, the second yoke leg 14' can be accurately position relative to the core 12' and the associated first yoke leg and the armature.

Figure 11B:
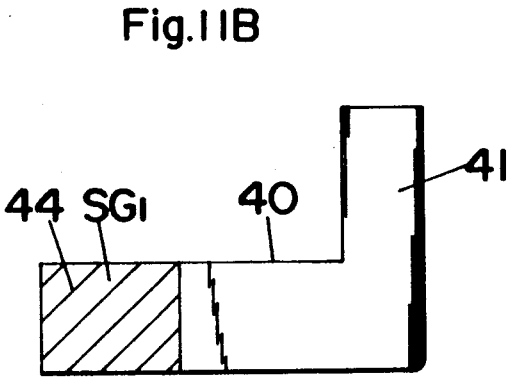
FIGS. 11A and 11B are schematic views illustrating the dimensional relation of the electromagnet with the associated armature.
Figure 12B:
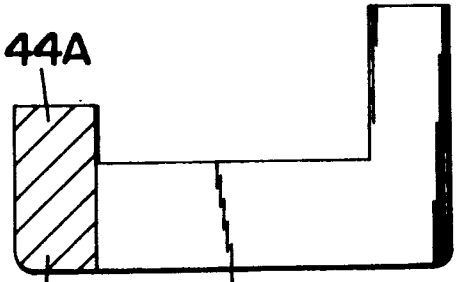
Fig.12B (PRIOR ART)
FIGS. 12A and 12B are schematic views illustrating the like dimensional relation of the prior art electromagnet of FIG. 1 with the associated armature, for comparison with FIGS. 12A and 12B.
Figure 11A:
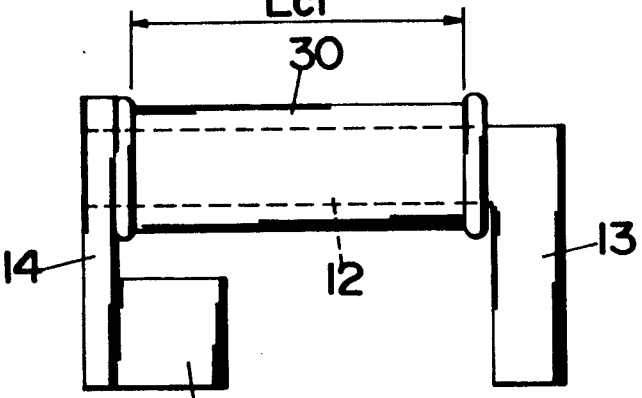
Figure 12A:
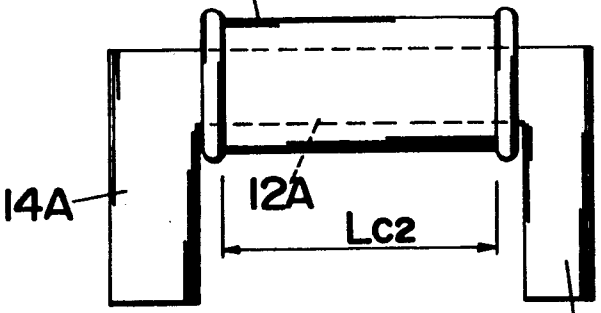
Fig.12A (PRIOR ART)

As discussed in the above embodiment, the present invention is characterized in that the second yoke leg 14 has the pole plate 16 which is bent toward the first yoke leg 13 so as to reduce a distance to be covered by the length of the armature 40, as schematically shown in FIG. 11A. With this result, the armature 40 can be formed to have a correspondingly reduced length as well as the pole end 44 of the armature 40 can have an increased gap forming surface area with the pole plate 16. This can be easily understood with reference to FIGS. 12A and 12B which illustrate the electromagnet structure of the prior art relay of FIG. 1, for comparison with FIGS. 11A and 11B. That is, as the pole plate 16 extends toward the first yoke leg 13, the armature 40 can have a correspondingly reduced length which is less than that of the prior art armature 40A of FIG. 12B, while assuring an increased gap forming surface area SG1 greater than that SG2 for the prior art armature 40A. Consequently, the armature 40 of the present invention can have a equivalent mass M1 less than that M2 of the prior art armature 40A [M1<M2], which enhances an armature attraction force at the same level of electromagnetic energy obtained from the energization of the excitation coil 30. Further, as apparent from comparison between the electromagnet structure of FIGS. 11A and 12A, the excitation coil 30 of the present invention can be wounded over a longer distance LC1 than that LC2 permitted in the prior art structure of FIG. 12A, provided that the electromagnetic structure for both of the present invention and the prior art are designed to have an equal overall length. That is, the excitation coil 30 of the present invention can have more number of turns than that of the prior art under the limitation of occupying the same coil thickness, whereby enabling to generate a correspondingly stronger electromagnetic force and therefore providing a still stronger armature attraction force for stable and reliable armature operation. In other words, since the second yoke leg 14 of the present invention adds to the length of the electromagnetic structure only by a thickness thereof, and not the width dimension of the pole plate as seen in FIG. 12A of the prior art structure, the electromagnetic structure of the present invention can have a reduced length as opposed to that of the prior art structure when the excitation coil is wound over the same distance along the core 12.

What is claimed is:

1. In a miniaturized electromagnet comprising:

an L-shaped flat magnetic plate of magnetic material with a horizontally extending core and a first yoke leg integrally depending from one end of said core, said L-shaped magnetic plate and first yoke leg lying in a first plane;

a coil assembly with an excitation coil dispersed around said core to define a coil thickness extending horizontally perpendicular to the length of said core;

a second yoke leg made of magnetic material and depending from the other end of said core in an opposed relation to said first yoke leg; and an armature bridging between said first and second yoke legs in parallel with the length of said core, said armature having a pivot end and a pole end at opposite ends thereof and pivotally supported at said pivot end adjacent to the first yoke leg with said pivot end in constant magnetic coupling to said first yoke leg such that said armature is pivotable about said pivot end in a horizontal plane parallel to a plane of said core within said coil thickness between a set position and a reset position of having said pole end attracted to and spaced away from said second yoke leg upon energization and deenergization of said excitation coil, respectively;

said second yoke leg being of a flat plate configuration having a general plane extending perpendicular to said first plane and to have its lower end portion bent to define thereat a pole plate which is disposed in a plane parallel to said pole plate being positioned in an overlapping relation to said pole end of said armature for attaching said pole end to said pole plate upon energization of said excitation coil.

2. A miniature electromagnet as set forth in claim 1, wherein said second yoke leg is made separately from said flat magnetic plate and is thereafter rigidly secured to said other end of 15 said core.

3. A miniature electromagnet as set forth in claim 1, including a support member disposed in an adjacent relation to said first yoke leg, said support member formed with a pair of vertically spaced bearing holes into which a corresponding pair of projections formed on said pivot end of said armature are seated, respectively, to allow the pivotal movement of said armature.

4. A miniature electromagnet as set forth in claim 2, wherein said second yoke leg is formed with a cavity into which one end of said core is fitted and secured thereto by a laser beam welding.

5. A miniature electromagnet as set forth in claim 1, wherein said pole plate is bent at substantially a right angle with respect to the plane of said second yoke leg by cold-forging in such a manner as to leave no substantial notch between said pole plate and the remaining portion of said second yoke leg.

6. A miniature electromagnetic relay as set forth in claim 1, further including a fixed contact and a movable contact operatively connected to said armature to be movable therewith between a closed condition of engaging said fixed contact and an open condition of disengaging from said fixed contact, and said fixed contact and movable contact being disposed within said coil thickness as well as within the length of said flat magnetic plate in vertically spaced relation to said excitation coil.

* * * * *